US009318051B2

(12) United States Patent
Lim

(10) Patent No.: US 9,318,051 B2
(45) Date of Patent: Apr. 19, 2016

(54) DISPLAY DEVICE AND DRIVING METHOD THEREOF

(71) Applicant: Samsung Display Co., Ltd., Yongin (KR)

(72) Inventor: Myeong-Bin Lim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 141 days.

(21) Appl. No.: 14/019,042

(22) Filed: Sep. 5, 2013

(65) Prior Publication Data

US 2014/0347335 A1 Nov. 27, 2014

(30) Foreign Application Priority Data

May 27, 2013 (KR) ..... 10-2013-0059845

(51) Int. Cl.
*G09G 3/32* (2006.01)
*G09G 3/20* (2006.01)

(52) U.S. Cl.
CPC ..... *G09G 3/3258* (2013.01); *G09G 3/2022* (2013.01); *G09G 2320/0219* (2013.01)

(58) Field of Classification Search
CPC combination set(s) only.
See application file for complete search history.

(56) References Cited

U.S. PATENT DOCUMENTS

| | | | | |
|---|---|---|---|---|
| 2007/0164959 | A1* | 7/2007 | Childs | 345/92 |
| 2010/0134514 | A1* | 6/2010 | Woo et al. | 345/589 |
| 2010/0214276 | A1* | 8/2010 | Tanikame et al. | 345/211 |
| 2012/0319929 | A1* | 12/2012 | Uchino et al. | 345/76 |

FOREIGN PATENT DOCUMENTS

| | | |
|---|---|---|
| JP | 2002-366105 | 12/2002 |
| KR | 10-2004-0076100 | 8/2004 |
| KR | 10-2011-0124039 | 11/2011 |
| KR | 10-2012-0111641 | 10/2012 |

* cited by examiner

*Primary Examiner* — Robin Mishler
(74) *Attorney, Agent, or Firm* — H.C. Park & Associates, PLC

(57) ABSTRACT

A display device includes a pixel, a data line, a scan line, a data driver, and a scan driver. The pixel is configured to display an image. The data line is configured to transmit data voltages to the pixel. The scan line is configured to transmit a scan signal to the pixel. The data driver is configured to: float the data line during a first period of a frame, apply, after the first period, a first data voltage to the data line during a second period of the frame, and apply, after the second period, a voltage waveform to the data line that varies the applied voltage from the first data voltage to a target voltage during a third period of the frame. The scan driver is configured to selectively apply the scan signal to the scan line.

20 Claims, 3 Drawing Sheets

DISPLAY DEVICE AND DRIVING METHOD THEREOF

CROSS-REFERENCE TO RELATED APPLICATION

This application claims priority from and the benefit of Korean Patent Application No. 10-2013-0059845, filed on May 27, 2013, which is incorporated by reference for all purposes as if set forth herein.

BACKGROUND

1. Field

Exemplary embodiments relate to a display device and a driving method thereof, and, more particularly, to an organic light emitting diode (OLED) display device and a driving method thereof.

2. Discussion

Conventional flat panel display devices include, for instance, liquid crystal displays (LCDs), field emission displays (FEDs), plasma display panels (PDPs), electrophoretic displays (EPDs), electrowetting displays (EWDs), organic light emitting diode (OLED) displays, etc. In particular, OLED displays typically include a display panel to display an image using a plurality of pixels. Each of the pixels usually includes an OLED as a self-light emitting element (or component). The display panel may include a plurality of scan lines formed in a first (e.g., row) direction and a plurality of data lines formed in a second (e.g., column) direction. To this end, each of the plurality of pixels may display an image based on a scan signal and a data signal transmitted from a corresponding scan line and a corresponding data line connected thereto.

Traditionally, OLED displays may present an image frame that includes a high impedance terminal (Hiz) period and a driving period. In the Hiz period, the data lines may be floated, and the OLEDs of the pixels may be discharged by a voltage amount, such as, for example, by a ground voltage. In a voltage variance period of the driving period, after a target voltage, such as, for instance, 10 V, is applied to the data lines, a data voltage for image display may be applied to the data lines to display the image. However, in the voltage variance period after the Hiz period, a current may flow (e.g., simultaneously flow) in the data lines. This flow of current may cause issues when a peak current is increased.

The above information disclosed in this Background section is only for enhancement of understanding of the background of the invention, and, therefore, it may contain information that does not form the prior art that is already known in this country to a person of ordinary skill in the art.

SUMMARY

Exemplary embodiments provide a display device and a driving method thereof configured to remove (or otherwise reduce) a peak current that may occur after a high impedance terminal (Hiz) period, which may increase display quality of the display device.

Additional aspects will be set forth in the detailed description which follows and, in part, will be apparent from the disclosure, or may be learned by practice of the invention.

According to exemplary embodiments, a display device includes a pixel, a data line, a scan line, a data driver, and a scan driver. The pixel is configured to display an image. The data line is configured to transmit data voltages to the pixel. The scan line is configured to transmit a scan signal to the pixel. The data driver is configured to: float the data line during a first period of a frame, apply, after the first period, a first data voltage to the data line during a second period of the frame, and apply, after the second period, a voltage waveform to the data line that varies the applied voltage from the first data voltage to a target voltage during a third period of the frame. The scan driver is configured to selectively apply the scan signal to the scan line.

According to exemplary embodiments, a method, includes: receiving a video signal; displaying, via a pixel connected to a data line, an image corresponding to the video signal during a first period of a frame based on the video signal; floating, before the first period, the data line during a second period of the frame; and applying a voltage waveform to the data line during a third period of the frame, the third period being disposed between the second period and the first period. The voltage waveform varies from a first voltage to a target voltage.

According to exemplary embodiments, an apparatus, includes: at least one processor; and at least one memory including computer code, the computer code being configured to, when executed by the at least one processor, cause the apparatus at least to: float a data line connected to a pixel during a first portion of a frame of an image signal, apply, after the first portion, a data voltage to the data line during a second portion of the frame, and apply, after the second portion, a voltage waveform to the data line during a third portion of the frame, the voltage waveform varying from the data voltage to a target voltage.

The foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
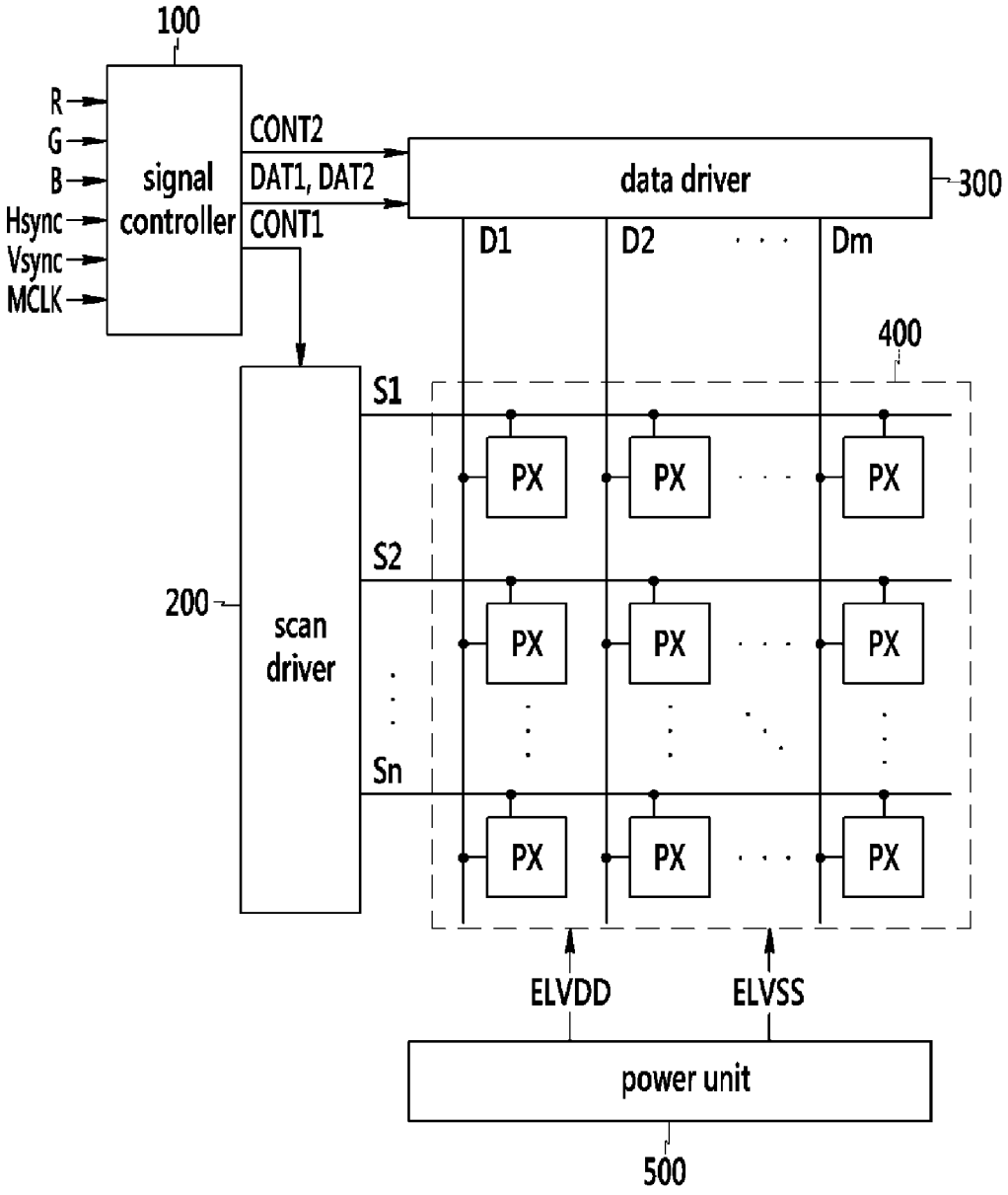
FIG. 1 is a block diagram of a display device, according to exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a block diagram of a display device, according to exemplary embodiments.

Referring to FIG. 1, a display device may include a signal controller (or controller) 100, a scan driver 200, a data driver 300, a display unit 400, and a power unit 500. Although specific reference will be made to this particular implementation, it is also contemplated that the display device may embody many forms and include multiple and/or alternative components. For example, it is contemplated that the components of the display device may be combined, located in separate structures, and/or separate locations.

According to exemplary embodiments, controller 100 is configured to receive one or more video signals (e.g., one or more external video signals) R, G, and B from a source (e.g., a source device external to the display device) and one or more input control signals associated with controlling the display of the video signal R, G, and B. Although illustrated as separate signals, the video signal(s) and/or one or more of the input control signal(s) may be combined or otherwise multiplexed for transmission and/or reception on a shared medium. For descriptive convenience the one or more video signals R, G, and B, will be referred to hereinafter as video signal RGB. The video signal RGB may include luminance information for one or more pixels PX of the display unit 400. It is noted that the luminance information may include a number of grayscale values (or grays), such as, for example, $1024=2^{10}$ grays, $256=2^{8}$ grays, $64=2^{6}$ grays, etc. Further, it is noted that the input control signals may include, for example, a vertical synchronization signal Vsync, a horizontal synchronization signal Hsync, a main clock signal MCLK, etc.

The controller 100 may process the video signal RGB in correspondence with one or more operation conditions of the display unit 400 and the data driver 300 based on the video signal RGB and the input control signals. In this manner, the controller may generate one or more other control signals, such as, for instance, a scan control signal CONT1, a data control signal CONT2, an image data signal DAT1, and a protocol data signal DAT2.

In exemplary embodiments, the controller 100 may divide the video signal RGB by frames according to the vertical synchronization signal Vsync, as well as divide the video signal RGB in association with the scan lines S1-Sn according to the horizontal synchronization signal Hsync. To this end, the controller 100 may also generate the image data signal DAT1 and the protocol data signal DAT2. The controller 100 is configured to transmit the scan control signal CONT1 to the scan driver 200, and transmit the data control signal CONT2, the image data signal DAT1, and the protocol data signal DAT2 to the data driver 300.

According to exemplary embodiments, a frame includes a high impedance terminal (Hiz) period and a driving period. The driving period may include a voltage variance (e.g., a voltage increase or decrease period) and a light emitting period. The Hiz period is a period in which data lines D1-Dm are floated. The floated data lines D1-Dm are referred to as being in a "high impedance" state. The voltage variance period of the driving period is a period in which a target voltage is applied to the data lines D1-Dm according to the protocol data signal DAT2. According to exemplary embodiments, the voltage of the data lines D1-Dm is gradually varied to reach the target voltage in an initialization period of the driving period. The light emitting period of the driving period is a period in which an image is displayed according to the image data signal DAT1.

The display unit 400 may include the plurality of data lines D1-Dm longitudinally extending in a first (e.g., column) direction, the plurality of scan lines S1-Sn longitudinally extending in a second (e.g., row) direction, and the plurality of pixels PX disposed in association with the respective intersections of the data lines D1-Dm and scan lines S1-Sn. Each of the plurality of pixels PX may be configured to display any suitable color, such as, for instance, red (R), green (G), blue (B), etc. The plurality of data lines D1-Dm is configured to transmit data voltages corresponding to the image data signal DAT1 to the plurality of pixels PX, respectively. The plurality of scan lines S1-Sn is configured to transmit a scan signal for selecting the pixels PX to the plurality of pixels PX, respectively. The pixels PX are, respectively, activated (e.g., "turned on") when a corresponding scan signal transmitted through a corresponding scan line (e.g., scan line S1), and an associated light emitting element of the pixel PX emits light based on a driving current according to a corresponding data voltage transmitted to the pixel PX by a corresponding data line (e.g., data line D1). In this manner, the pixel PX may display an image.

According to exemplary embodiments, the scan driver 200 is configured to transmit a plurality of scan signals to the plurality of scan lines S1-Sn, respectively, according to the scan control signal CONT1. The data driver 300 is configured to transmit a plurality of data signals corresponding to the image data signal DAT1 and the protocol data signal DAT2 to the plurality of data lines D1-Dm, respectively, according to the data control signal CONT2. To this end, the power unit 500 is configured to supply power source voltages ELVDD and ELVSS to the plurality of pixels PX.

In exemplary embodiments, the controller 100, the scan driver 200, the data driver 300, and the power unit 500, and/or one or more components thereof, may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

According to exemplary embodiments, the features/functions/processes described herein may be implemented via software, hardware (e.g., general processor, digital signal processing (DSP) chip, an application specific integrated circuit (ASIC), field programmable gate arrays (FPGAs), etc.), firmware, or a combination thereof. In this manner, the controller 100, the scan driver 200, the data driver 300, and the power unit 500, and/or one or more components thereof may include or otherwise be associated with one or more memories (not shown) including code (e.g., instructions) configured to cause the controller 100, the scan driver 200, the data driver 300, and the power unit 500, and/or one or more components thereof to perform one or more of the features/functions/processes described herein.

The memories may be any medium that participates in providing code/instructions to the one or more software, hardware, and/or firmware for execution. Such memories may take many forms, including but not limited to non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

Figure 2:
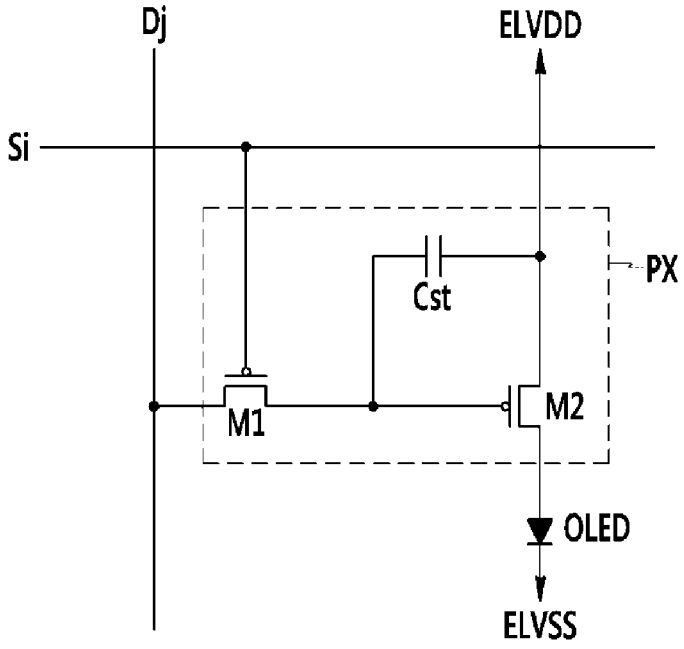
FIG. 2 is a schematic circuit diagram of an illustrative pixel of the display device of FIG. 1, according to exemplary embodiments.

FIG. 2 is a schematic circuit diagram of an illustrative pixel of the display device of FIG. 1, according to exemplary embodiments.

Referring to FIG. 2, the pixel PX is connected to an i-th scan line Si and a j-th data line Dj, where "i" and "j" are natural numbers greater than zero. The pixel PX may include a first switching unit (e.g., transistor) M1, a second switching unit (e.g., driving transistor) M2, a voltage storage device (e.g., capacitor) Cst, and an organic light emitting diode OLED. It is contemplated, however, that any other suitable configuration may be utilized. Further, although the switching transistor M1 and the driving transistor M2 are depicted as p-channel metal oxide semiconductor (PMOS) transistors of a p-channel type, any other suitable switching unit may be utilized, such as an n-channel type transistor, etc.

According to exemplary embodiments, the switching transistor M1 includes a gate electrode connected to the scan line Si, a first (e.g., source) electrode connected to the data line Dj, and a second (e.g., drain) electrode connected to a gate electrode of the driving transistor M2. The driving transistor M2 includes a first (e.g., source) electrode connected to the power source voltage ELVDD, a second (e.g., drain) electrode connected to a first electrode (e.g., anode) of the OLED, and a gate electrode connected to the second electrode of the switching transistor M1. The gate electrode of the driving transistor M2 is configured to receive a data signal during a period in which the switching transistor M1 is "turned on." The capacitor Cst is connected between the gate electrode and the first electrode of the driving transistor M2. A second electrode (e.g., cathode) of the OLED is connected to the power source voltage ELVSS.

In exemplary embodiments, when the switching transistor M1 is "turned on" by the scan signal transmitted through the scan line Si, and the data signal transmitted through the is data line Dj is provided to the gate electrode of the driving transistor M2, the pixel PX may operate to display an image. In this manner, the capacitor Cst may maintain a voltage difference between a voltage of the gate electrode corresponding to the data signal and a voltage of the first electrode of the driving transistor M2 for a period of time. This voltage difference may cause, at least in part, a driving current to flow through the driving transistor M2. The driving current may cause, at least in part, the OLED to emit light to display an image in accordance with one or more aspects of the driving current flowing through the driving transistor M2. As such, the pixel PX may be considered in an operational state during a light emitting period of the driving period.

Figure 3:
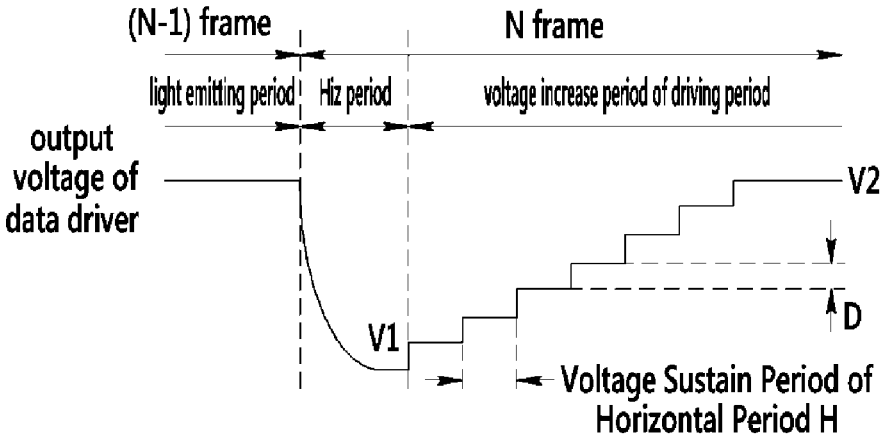
FIG. 3 is diagram of an output voltage of a data driver of the display device of FIG. 1, according to exemplary embodiments.

FIG. 3 is a diagram of an output voltage of a data driver, according to exemplary embodiments. For illustrative convenience, only the light emitting period of the driving period is depicted in an (N−1)-th frame, and only the Hiz period and the voltage variance period of the driving period are depicted in an N-th frame, where "N" is a natural number greater than zero.

Referring to FIGS. 1-3, in the light emitting period of an (N−1)-th frame, the data driver 300 is configured to apply data voltages corresponding to an image data signal DAT1 of the (N−1)-th frame to one or more of the plurality of data lines D1-Dm. To this end, one or more scan signal may be selectively applied, by, for example, the scan driver 200, to one or more of the plurality of scan lines S1-Sn to select one or more of the pixels PX that are to display an image. As such, after the light emitting period of the (N−1)-th frame, an N-th frame may begin.

In association with the Hiz period of the N-th frame, the plurality of data lines D1-Dm are floated by the data driver 300. As such, an output voltage of the data driver 300 may be reduced. For example, during the Hiz period, the output voltage of the data driver 300 may be set to 0 V. In addition, during the Hiz period, the OLED may be discharged. For example, during the Hiz period, when a voltage, such as, 0 V is applied to the data lines D1-Dm, and the is switching transistor M1 is "turned on" by a scan signal transmitted one or more of the plurality of scan lines S1-Sn, the respective capacitors Cst may be discharged. Further, the electrodes of the corresponding OLEDs may be connected to a ground terminal, so that the OLEDs may be discharged. As such, during the Hiz period, the pixels PX may be initialized.

According to exemplary embodiments, during a voltage variance period of the driving period of the N-th frame, the data driver 300 may apply, a voltage, which may gradually vary from a first voltage V1 to a target voltage V2, to one or more of the plurality of data lines D1-Dm according to the protocol data signal DAT2. Although FIG. 3 illustrates V2 being greater than V1, it is contemplated that V2 may be less than V1. The protocol data signal DAT2 may include a voltage variance amount D. The data driver 300 may determine a voltage sustain period using the voltage variance amount D, a length of the voltage variance period, the first voltage V1, and the target voltage V2. To this end, the data driver 300 may apply the first voltage V1 to one or more of the plurality of data lines D1-Dm in the voltage sustain period and then apply a voltage (e.g., V1+D or V1−D), which is varied by the voltage variance amount D, to the one or more of the plurality of data lines D1-Dm in the voltage sustain period. In this manner, the data driver 300 may continue to vary the applied voltage to the target voltage V2 to the one or more of the plurality of data lines D1-Dm.

For example, when V1 is 0 V, V2 is 10 V, and the voltage variance period is 50 horizontal H periods, the data driver 300 may apply each voltage, which is varied by an amount equal to (V2−V1)/50, that is, 0.2V per horizontal H period, to the one or more of the plurality of data lines D1-Dm. The voltage applied to the one or more of the plurality of data lines D1-Dm may be varied in a ramp shape, a step shape, a gradually changing shape, an arbitrary shape, etc. To this end, the voltage variance amount D and/or the voltage sustain period may be constant or variable over the various horizontal periods of the voltage variance period. In this manner, the horizontal periods H may be constant or variable over the voltage variance period of the driving period. To this end, the shape (or profile) of the voltage variance may be determined (or otherwise controlled) by the protocol data signal DAT2.

According to exemplary embodiments, during the voltage variance period of the driving period, as the voltage applied to the plurality of data lines D1-Dm is gradually varied, the effects of a peak current may be diminished.

Further, once the target voltage V2 is applied to the one or more of the plurality of data lines D1-Dm, the light emitting period of the driving period of the N frame may begin. As such, in the light emitting period, a plurality of data voltages corresponding to the image data signal DAT1 of the N-th frame may be applied to the one or more of the plurality of data lines D1-Dm to cause, at least in part, the associated pixels PX to display an image.

Figure 4:
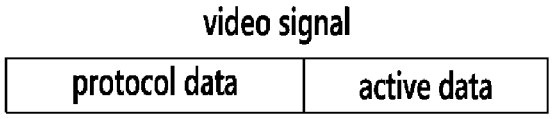
FIG. 4 is a block diagram of an illustrative video signal, according to exemplary embodiments.

FIG. 4 is a block diagram of an illustrative video signal, according to exemplary embodiments.

Referring to FIG. 4, the video signal RGB includes active data associated with protocol data and luminance information for each pixel PX. According to exemplary embodiments, the protocol data may include the voltage variance amount D as described in conjunction with FIG. 3. The voltage variance amount D may be denoted as a grayscale value representing luminance.

It is noted that an output voltage related to 1 grayscale of the data driver 300 may be between 5 and 10 mV. As such, the voltage variance amount D may be denoted as bit data showing the grayscale. For example, the grayscale and the bit data HO [3:1] may be mapped as shown in Table 1.

TABLE 1

| Voltage Variance Amount | HO [3:1] |
|---|---|
| disable | 0000 |
| 4 Gray | 0001 |
| 8 Gray | 0010 |
| 12 Gray | 0011 |
| 16 Gray | 0100 |
| 20 Gray | 0101 |
| 24 Gray | 0110 |
| 28 Gray | 0111 |
| 32 Gray | 1000 |
| 36 Gray | 1001 |
| 40 Gray | 1010 |
| 44 Gray | 1011 |
| 48 Gray | 1100 |
| 52 Gray | 1101 |
| 56 Gray | 1110 |
| 60 Gray | 1111 |

As seen in Table 1, when, for example, the output voltage related to 1 grayscale is set to 5 mV, and the protocol data of "0101" is received, a voltage variance amount of 200 mV (i.e., 200 mV=5 mV/gray*40 gray). As such, when the data driver 300 receives, for example, the protocol data of "0101" through the protocol data signal DAT2, during the voltage variance period, a voltage gradually varied by the voltage variance amount of 200 mV from the first voltage V1 to the target voltage V2 is applied to the plurality of data lines D1-Dm.

According to exemplary embodiments, a peak current can be removed by driving a high impedance terminal (Hiz) in the aforementioned manner.

Although certain exemplary embodiments and implementations have been described herein, other embodiments and modifications will be apparent from this description. Accordingly, the invention is not limited to such embodiments, but rather to the broader scope of the presented claims and various obvious modifications and equivalent arrangements.

What is claimed is:

1. A display device, comprising:

a pixel configured to display an image;

a data line configured to transmit data voltages to the pixel;

a scan line configured to transmit a scan signal to the pixel;

a data driver configured to:

float the data line during a first period of a frame, apply, after the first period, a first data voltage to the data line during a second period of the frame, and apply, after the second period, a voltage waveform to the data line that varies the applied voltage from the first data voltage to a target voltage during a third period of the frame; and a scan driver configured to selectively apply the scan signal to the scan line.

2. The display device of claim 1, wherein:

the data voltages are applied to the data line in accordance with a video signal;

the video signal comprises grayscale data associated with the image and an incremental voltage variance amount; and the data driver is configured to control application of the voltage waveform based on the incremental voltage variance amount.

3. The display device of claim 2, wherein the data driver is configured to control a shape of the voltage waveform between the first voltage and the target voltage based on the incremental voltage variance amount.

4. The display device of claim 2, wherein the incremental voltage variance amount is set as bit data representing a grayscale.

5. The display device of claim 1, wherein the pixel comprises an organic light emitting component configured to emit light based on a driving current, the driving current being applied to the organic light emitting component during the first period.

6. The display device of claim 1, wherein the scan driver is configured to selectively apply the scan signal to the scan line during the first period.

7. The display device of claim 1, wherein the target voltage is less than or greater than the first voltage.

8. A method, comprising:

receiving a video signal;

displaying, via a pixel connected to a data line, an image corresponding to the video signal during a first period of a frame based on the video signal;

floating, before the first period, the data line during a second period of the frame; and applying, via a data driver, a voltage waveform to the data line during a third period of the frame, the third period being disposed between the second period and the first period, wherein the voltage waveform varies from a first voltage to a target voltage.

9. The method of claim 8, wherein:

the video signal comprises grayscale data associated with the image and an incremental voltage variance amount; and a shape of the voltage waveform is controlled based on the grayscale data and the incremental voltage variance amount.

10. The method of claim 8, wherein displaying the image comprises selectively applying a scan signal to a scan line connected to the pixel.

11. The method of claim 9, further comprising:

determining a voltage sustain period based on a length of the third period, the incremental voltage variance amount, the first voltage, and the target voltage, wherein applying the voltage waveform comprises:

determining at least one incremental voltage to apply to the data line based on the incremental voltage variance amount, applying the at least one incremental voltage to the data line during the voltage sustain period.

12. The method of claim 9, wherein the voltage variance amount is set as bit data corresponding to a grayscale.

13. The method of claim 8, wherein floating the data line comprises electrically grounding an organic light emitting element of the pixel to discharge the organic light emitting element.

14. The display device of claim 3, wherein the data driver is configured to control a shape of the waveform based on a duration of a voltage sustain period of the third period.

15. The display device of claim 1, wherein the waveform comprises a ramped shape, a stepped shape, or a gradually changing shape.

16. The method of claim 11, wherein a shape of the waveform is controlled based on a duration of the voltage sustain period.

17. The method of claim 8, wherein the waveform comprises a ramped shape, a stepped shape, or a gradually changing shape.

18. A data driver, comprising:

at least one processor; and at least one memory comprising computer code, the computer code being configured to, when executed by the at least one processor, cause the data driver at least to:

float a data line connected to a pixel during a first portion of a frame of an image signal, apply, after the first portion, a data voltage to the data line during a second portion of the frame, and apply, after the second portion, a voltage waveform to the data line during a third portion of the frame, the voltage waveform varying from the data voltage to a target voltage.

19. The data driver of claim 18, wherein the computer code is further configured to, when executed by the at least one processor, cause the data driver at least to:

apply, at least after the target data voltage is applied to the data line, a scan signal to a scan line connected to the pixel.

20. The data driver of claim 18, wherein the computer code is further configured to, when executed by the at least one processor, cause the data driver at least to:

determine an incremental voltage variance amount based on the image signal and a duration of the third portion, wherein a shape of the voltage waveform is controlled based on the incremental voltage variance amount.

* * * * *